United States Patent [19]

Cowdrey et al.

[11] 3,946,682

[45] Mar. 30, 1976

[54] SWINGAWAY CONVERTIBLE BED CABINETS

[75] Inventors: Roy Melvin Cowdrey, Cranford; Robert Seymour Peets, Watchung, both of N.J.

[73] Assignee: The Singer Company - Patent Department, New York, N.Y.

[22] Filed: Oct. 25, 1974

[21] Appl. No.: 517,981

[52] U.S. Cl. ..... 112/217.1; 312/21

[51] Int. Cl.[2] ..... D05B 75/00

[58] Field of Search ..... 112/217.1, 258, 260; 312/21, 30, 196

[56] References Cited

UNITED STATES PATENTS

| | | | |
|---|---|---|---|
| 683,499 | 10/1901 | Richards | 112/217.1 |
| 3,797,425 | 3/1974 | Peets | 112/217.1 |
| 3,823,993 | 7/1974 | Kakishima | 312/21 |

FOREIGN PATENTS OR APPLICATIONS

| | | | |
|---|---|---|---|
| 898,546 | 6/1962 | United Kingdom | 112/217.1 |

*Primary Examiner*—George H. Krizmanich
*Attorney, Agent, or Firm*—Marshall J. Breen; Edward L. Bell; Robert E. Smith

[57] ABSTRACT

A cabinet and work table for a sewing machine having a convertible work supporting bed capable of conversion from a flat work supporting bed to a cylinder bed. The cabinet work supporting surface is divided into two parts, a fixed rear work supporting surface and a laterally shiftable front work supporting surface. The sewing machine is supported in the cabinet with the flat work supporting bed forwardly of, co-planar and contiguous with the fixed work supporting surface. The shiftable work supporting surface of the cabinet is laterally shiftable from a position co-planar with the fixed work supporting surface of the cabinet and the flat work supporting bed of the sewing machine to a position subjacent the flat work supporting bed of the sewing machine and the fixed work supporting surface of the cabinet whereupon the flat bed may be converted to cylinder bed use. An unexpected benefit has been noted with the cabinet work supporting surfaces at two levels and the sewing machine in either flat bed or cylinder bed mode in that the sewing machine can be used with greater comfort and effectiveness.

8 Claims, 5 Drawing Figures

SWINGAWAY CONVERTIBLE BED CABINETS

BACKGROUND OF THE INVENTION

The invention is in the field of sewing machine cabinets, more particularly, those cabinets having the capability to support the sewing machine for free arm use in addition to for flat bed use.

The prior art cabinets in this field fall generally into two categories, those that accommodate to cylinder bed sewing from flat bed sewing by changing the level of the sewing machine by some form of elevator device such as in the U.S. Pat. No. 3,468,589 and those that accommodate to cylinder bed sewing by allowing a portion of the cabinet to be displaced from the sewing machine as for example U.S. Pat. Nos. 3,806,217 and 3,797,425. These cabinets have the drawbacks of being expensive to manufacture, cumbersome to use or allowing only limited clearance for use as a cylinder bed sewing machine with insufficient work supporting surface.

Simultaneous with the above developments in cabinets have been the developments in sewing machines themselves permitting ready conversion from flat bed use to cylinder bed use by rearrangement of a panel shiftably supported by the sewing machine bed. Such disclosures are contained in the U.S. patent application Ser. No. 445,508, filed on Feb. 25, 1974 and in the U.S. Pat. No. 3,344,762. The use of sewing machines so constructed greatly simplifies the change over from flat bed use to cylinder bed use in table top use of the sewing machine.

What is desired is a cabinet or work table which will accommodate those sewing machines having readily convertible beds, which cabinets may be equally as readily converted to cylinder bed use without any of the drawbacks noted for prior art cabinets, and, which will also further enhance the utility of the sewing machine.

SUMMARY OF THE INVENTION

The above desired ends are achieved in a work table with an elevated rear portion having a work supporting surface co-planar with a work supporting bed of a sewing machine supported in front of and contiguous to the rear portion. The work table is fashioned with a front portion contiguous to the rear portion but with a work supporting surface lower than the work supporting surface of the rear portion and the supporting bed of the sewing machine. The spacing between the work supporting bed of the sewing machine and the work supporting surface of the front portion may be made sufficient to expose a cylinder bed portion of a sewing machine having a convertible work supporting bed. Also, the front work table portion may be made laterally shiftable from a first position co-planar with a sewing machine work supporting bed convertible from flat bed to cylinder bed, to a second position subjacent the cylinder bed of the sewing machine.

DESCRIPTION OF THE DRAWINGS

The invention may be better understood by reference to the following figures in which.

REFERRING TO THE DRAWINGS

Figure 1:
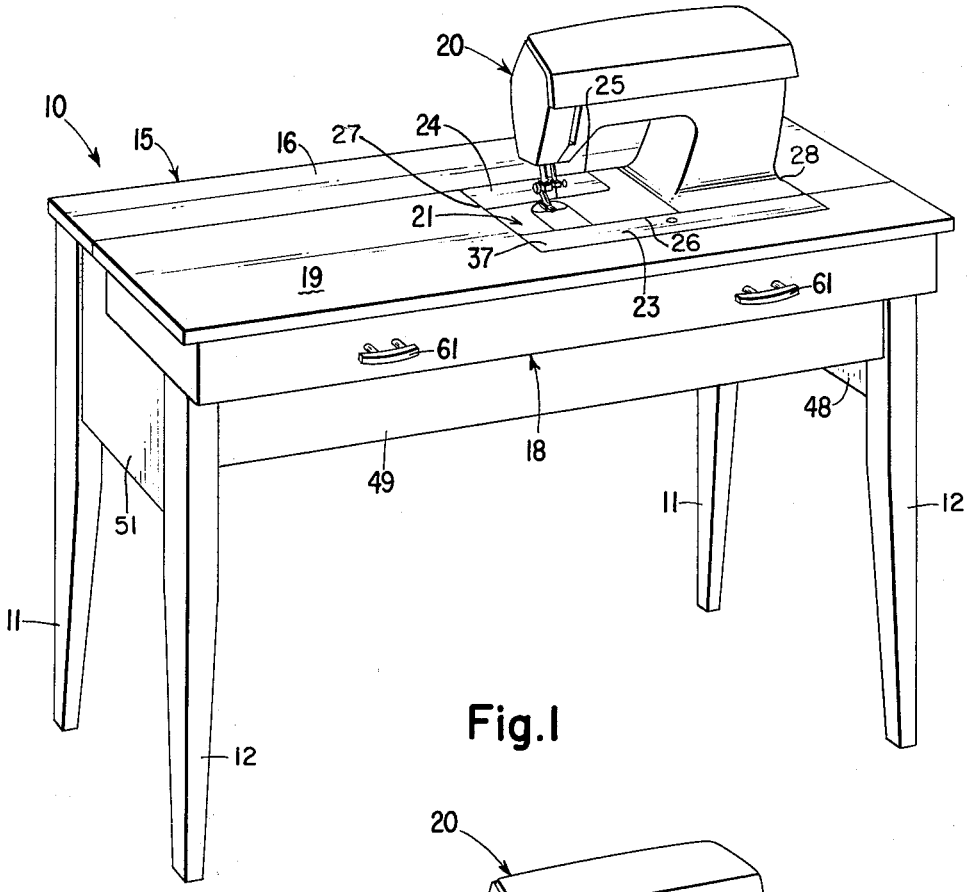
FIG. 1 is an isometric projection of a sewing machine cabinet with a sewing machine having a convertible bed in the flat bed mode.

In FIG. 1 is shown a sewing machine cabinet 10 in which is supported a convertible bed sewing machine 20 of the type described in the U.S. Pat. No. 3,344,762, issued on Oct. 3, 1967 to J. Szostak et al. The sewing machine 20 has a flat work supporting bed surface 21 which is composed of a flat work supporting portion 23 of a cylinder bed 22, and a hinged panel 24 which may be depressed, as is shown in FIG. 2, to expose an inner edge of the work supporting portion of the cylinder bed.

The work supporting bed surface 21 is bounded by a rear laterally disposed edge 25, a front laterally disposed edge 26, a first longitudinal edge 27 adjacent sewing instrumentalities including a needle carrying needle bar 29 and a second longitudinal edge 28 joining the front and rear laterally disposed edges. Part of the first longitudinal edge 27 and rear laterally disposed edge 25 are interrupted when the hinged panel 24 is depressed.

The cabinet 10 is supported by four legs 11 and is formed with a rear portion 15, having a rear work supporting surface 16, and a front portion 18, having a front work supporting surface 19. It is apparent from an inspection of FIGS. 1 and 2 that the front legs 12 are shorter than the rear legs 11 to accommodate a depression of the front work supporting surface 19 below the level of the rear work supporting surface 16. The sewing machine 20 is supported as will be described below with its flat work supporting bed surface 21 in front of and in co-planar arrangement with the rear work supporting surface 16, and in the position shown in FIG. 1, with the front work supporting surface 19.

Figure 2:
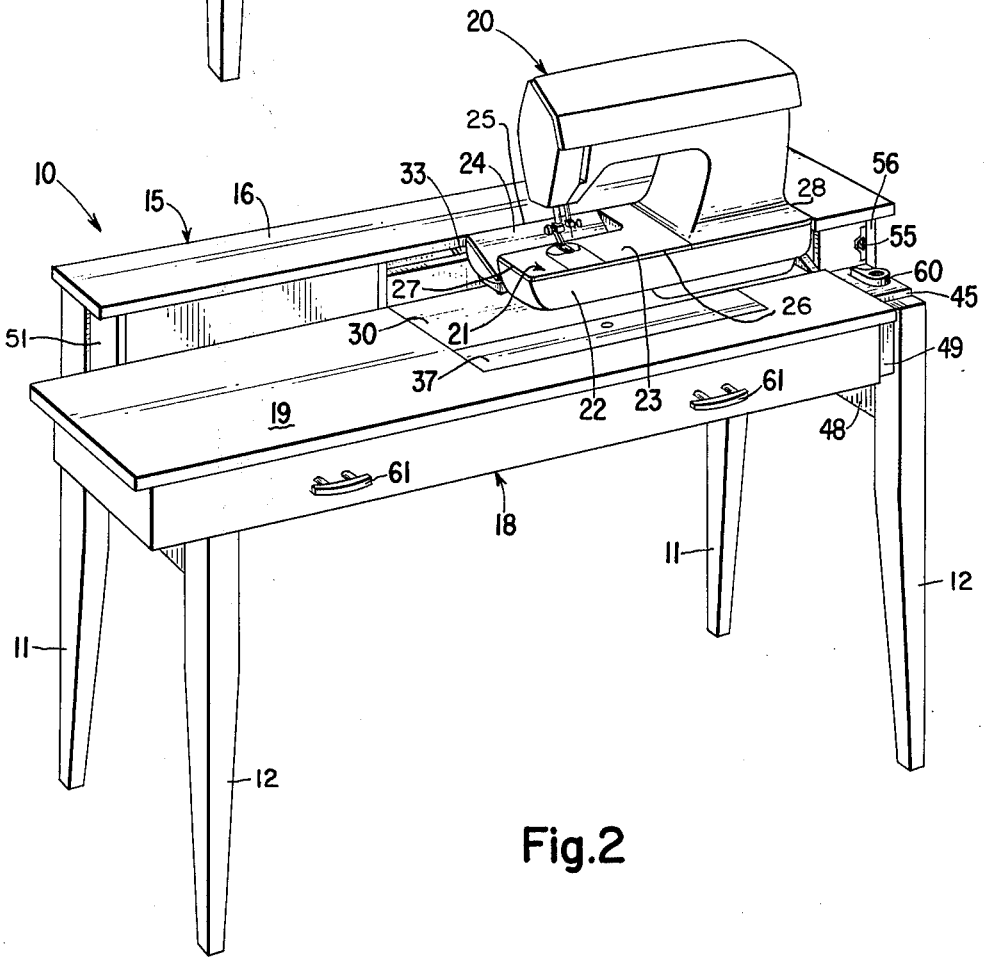
FIG. 2 is an isometric projection of a sewing machine cabinet similar to FIG. 1 but with the front table laterally shifted into the depressed position and the sewing machine with the convertible bed in the cylinder bed mode.

In FIG. 2, the cabinet 10 is shown with the front portion 18 laterally shifted parallel to the rear portion 15, to a depressed position with the front work supporting surface 19 beneath the level of the cylinder bed 22 of the sewing machine 20. With the cabinet portions 15 and 18 in this relative position, and when the hinged panel 24 is depressed as shown in FIG. 2, the inner edge and all surfaces of the cylinder bed 22 are exposed thereby permitting ready access for tubular work material which may be supported on the front work supporting surface 19 of the front portion 18 as it is operated upon. The position of the sewing machine 20 is not changed by depression of the front portion 18 of the cabinet 10, and remains at optimum level for operator comfort.

It has been noted that with the sewing machine 20 in either flat bed mode or cylinder bed mode and with the front portion 18 of the cabinet 10 depressed, greater operator comfort is realized and more effective sewing ensues. As an example, instead of guiding material down to the point of needle penetration as is required in a conventional cabinet due to the position of the guiding hand above the surface of a conventional cabinet, in a cabinet with a front portion depressed material may be guided into the sewing needle at the level of needle penetration. As noted above, the depressed portion has been found to be an ideal repository for the work material and is also an ideal repository for other sewing accessories, such as scissors, needle threaders, instruction booklets, or other items frequently used by an operator, since movement of the work material through the sewing machine is little affected by these items and has no effect on these items and will not carry them from the front work supporting surface.

A preferred means for depressing the front portion 18 of the cabinet 10 and supporting the sewing machine 20 in the cabinet will be explained, below recognizing however, that it is not the only means available for accomplishing those functions or that a cabinet may be manufactured with the front portion in a permanently depressed state to obtain the advantages cited above.

Figure 3:
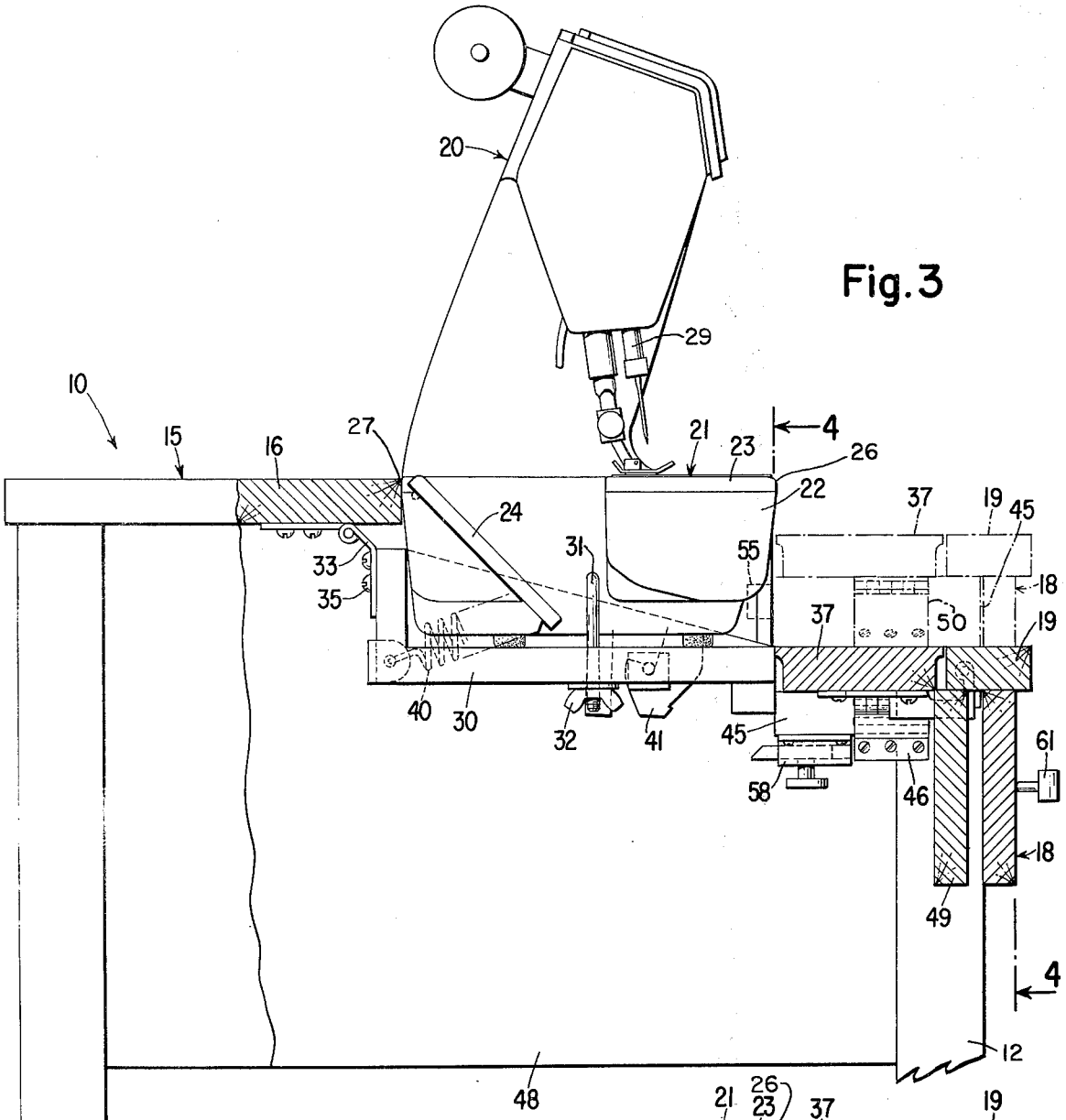
FIG. 3 is an end elevation of the sewing machine cabinet in section with the front table shown partially depressed in dot-dash lines and fully depressed in solid lines and with the sewing machine in the cylinder bed mode.

Referring to FIG. 3, the sewing machine 20 is supported in a tray 30 and is firmly held thereto by mounting hook 31 and nut 32. A pair of hinges 33, only one of which is visible, is attached by screws 35 to the tray and to the rear portion 15 of the cabinet 10. The sewing machine 20 and tray 30 are thus pivoted by the hinge 33 to swing into and out of storage position within the cabinet 10. A filler piece 37, also visible in FIGS. 1 and 2, is removed when the sewing machine is swung into and out of storage. Not shown is a second filler piece, which may be used to fill the cavity remaining when the sewing machine 20 is placed in storage, as is well known in the sewing machine cabinet art.

Also visible in FIG. 3 is a spring 40 and bracket 41, elements of a locking device used to support the sewing machine 20 and tray 30 selectively in the use position or in the storage position. Further details on the locking device may be had by reference to the U.S. Pat. No. 3,830,554 issued on Aug. 20, 1974 to Moussaian et al.

Figure 5:
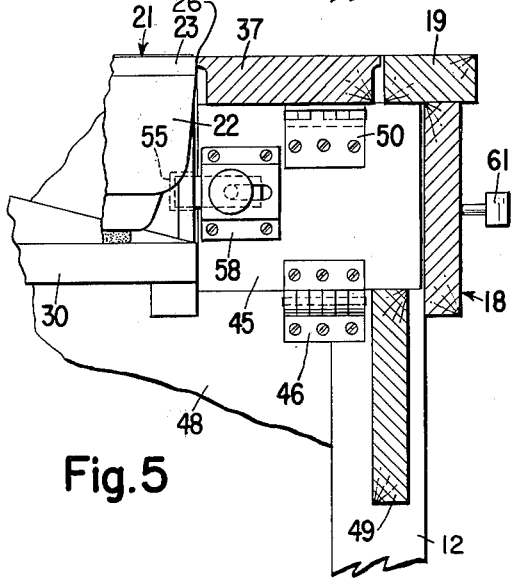
FIG. 5 is a fragmentary end elevational view similar to FIG. 3 but showing the front table held by the latch mechanism in fully elevated position.
Figure 4:
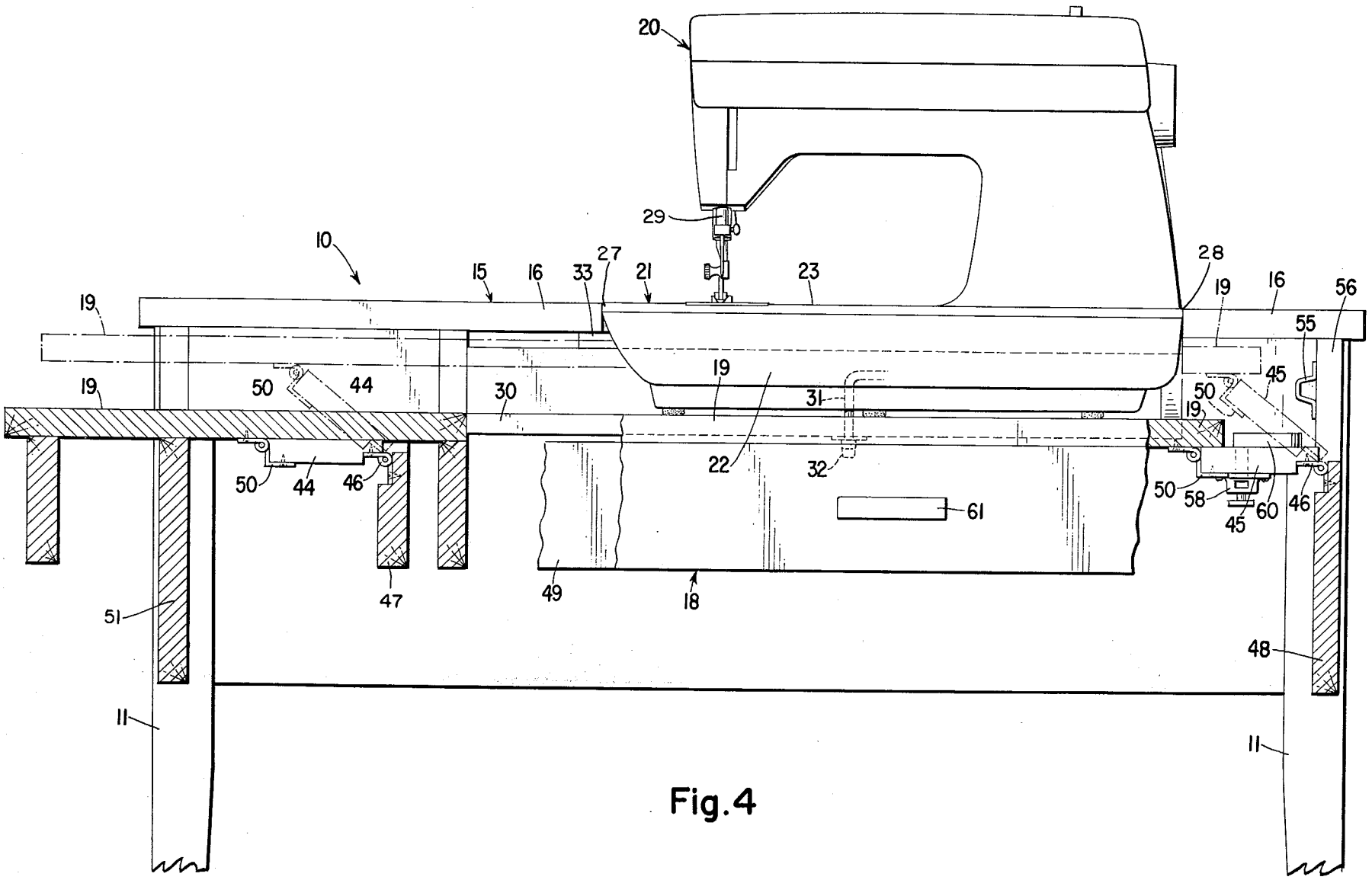
FIG. 4 is a section taken substantially along the line 4—4 in FIG. 3 showing the parallelogram mechanism for depressing the table illustrated with the partially depressed position shown in dotted lines.

In FIG. 4 the parallel motion mechanism for laterally shifting the front portion 18 to a depressed position is clearly visible. In broken lines in FIGS. 3 and 4 is shown the intermediate position of the front portion 18 to clearly illustrate the manner of operation. Thus a pair of support pannels 44, 45 are attached by a pair of hinges 46 to upstanding panels 48 in the cabinet 10. A second pair of hinges 50 are affixed to the top of support panels 44, 45 and the underside of the front work supporting surface 19, thereby obtaining parallel motion descent of the front work supporting surface to the subbase 49 in a position parallel to and contiguous with the rear portion 15 of the cabinet 10. As may be noted in FIGS. 1 and 2 the subbase 49 connects the front legs 12 to each other. Referring to FIGS. 1 and 2, an L shaped left side panel 51 connects left rear leg 11 to the shorter left front leg 12. From FIGS. 3 and 5 it may be seen that the right rear leg 11 and the shorter right front leg 12 are connected by the L shaped panel 48.

Also visible on the right-hand side of the cabinet 10 is a keeper 55 affixed to the inner side of upstanding panel 56 of the rear portion 15. A latch 58 affixed to the right support panel 45, is spring loaded rearwardly to engage with the keeper 55 when the front portion 18 is in an elevated position, to thereby maintain the front portion in the elevated position. A manual member 60 is operatively connected to the latch 58 to enable the latch to be withdrawn from engagement with the keeper 55 that the front portion 18 may be shifted to a depressed position with the aid of handles 61. Particulars of the latch and keeper arrangement are more clearly apparent in FIG. 5.

Having thus described the nature of the invention, what I claim herein is:

1. A work table for a sewing machine having sewing instrumentalities including a needle carrying needle bar and a work supporting bed formed with a rear laterally disposed edge, a front laterally disposed edge, a first longitudinal edge adjacent said sewing instrumentalities and a second longitudinal edge joining said laterally disposed edges, said work table comprising: a rear, laterally elongate, work table portion having a rear work supporting surface; means supporting said sewing machine with said rear laterally disposed edge of said work supporting bed contiguous to and forwardly of said rear work table portion, with said first longitudinal edge forwardly of said rear work table portion, and with said work supporting bed co-planar with said rear work supporting surface; and, a front, laterally elongate, work table portion have a front work supporting surface, said front work table portion being located forwardly of and contiguous to said rear work table portion laterally beyond said sewing machine first longitudinal edge to the lateral end of said rear work table portion, said front work supporting surface being space below said work supporting bed of said sewing machine and rear work supporting surface of said rear work table portion.

2. A work table as claimed in claim 1 wherein said work supporting bed is convertible from flat bed to cylinder bed, and wherein said work supporting surface of said front work table portion is spaced below said cylinder bed of said sewing machine.

3. A cabinet for a sewing machine having sewing instrumentalities including a needle carrying needle bar and a work supporting bed, said work supporting bed having a rear laterally disposed edge and a front laterally disposed edge, a first longitudinal edge adjacent said sewing instrumentalities and a second longitudinal edge joining said laterally disposed edges, said cabinet comprising: a fixed rear, laterally elongate, cabinet portion having a rear work supporting surface; means pivotably supporting said sewing machine in an operative position with said rear laterally disposed edge contiguous to and forwardly of said rear cabinet portion and with said work supporting bed co-planar with said rear work supporting surface; a front, laterally elongate, cabinet portion having a front work supporting surface, said front cabinet portion being located forwardly of and contiguous to said rear cabinet portion laterally beyond said sewing machine first longitudinal edge to the lateral end of said rear cabinet portion; and means for supporting said front cabinet portion selectively in a first position with said front cabinet portion co-planar with said rear work supporting surface of said rear cabinet portion and contiguous said first longitudinal edge of said sewing machine work supporting bed, and in a second position with said front work supporting surface of said front cabinet portion depressed below said work supporting bed and contiguous said rear cabinet portion.

4. A cabinet as claimed in claim 3 wherein said work supporting bed is convertible from flat bed to cylinder bed and wherein said front work supporting surface of said front cabinet portion in said second position is depressed below said cylinder bed.

5. A cabinet as claimed in claim 3 wherein said means pivotably supporting said sewing machine includes: a tray, means supporting said sewing machine in said tray; hinge means connecting said rear cabinet portion to said tray; and means supporting said tray selectively with said sewing machine in an operative position and with said sewing machine in a stored position.

6. A cabinet as claimed in claim 3 wherein said means for supporting said front cabinet portion includes: a subbase; a parallel motion mechanism connecting said subbase to said front cabinet portion; keeper means mounted on said rear cabinet portion; and, latch means on said front cabinet portion removably engaged with said keeper means when said means for supporting said front cabinet portion is in said first position, said front cabinet portion resting on said subbase in said second portion.

7. A work table for a sewing machine having a work supporting bed, a standard rising from one extremity of said bed maintaining an arm in overhanging relation to said bed, said arm terminating in a head in which a sewing needle undergoes endwise reciprocation for cooperation with stitching instrumentalities in the opposite extremity of said bed in the formation of stitches;

said work table comprising a rear elongated work table portion having a rear work supporting surface; means for supporting said sewing machine with said bed contiguous with and forwardly of said rear elongated work table portion and with said bed co-planar with said rear work supporting surface; a front elongated work table portion having a front work supporting surface, said front elongated work table portion being located forwardly of and contiguous with said rear elongated work table portion and extending at least from said sewing machine work supporting bed adjacent said stitching instrumentalities laterally beyond said sewing machine to the side edge of said rear elongated work table portion and means for supporting said front elongated work table portion in a position with said front work supporting surface thereof arranged in a plane located below said sewing machine work supporting bed and below the rear work supporting surface of said rear elongated work table portion.

8. A worktable as claimed in claim 7 wherein said means for supporting said front elongated worktable portion is arranged also selectively to support said front elongated worktable portion in a position with said front work supporting surface coplanar and contiguous with said rear work supporting surface and with said sewing machine work supporting bed.

* * * * *